US006025789A

United States Patent [19]

Lane et al.

[11] Patent Number: 6,025,789

[45] **Date of Patent: *Feb. 15, 2000**

[54] TRAIN PROXIMITY DETECTOR

[75] Inventors: Brent A. Lane; Jack M. Erick, both of Amarillo, Tex.

[73] Assignee: Dynamic Vehicle Safety Systems, Ltd., Amarillo, Tex.

[ * ] Notice: This patent is subject to a terminal disclaimer.

[21] Appl. No.: 09/018,431

[22] Filed: Feb. 4, 1998

Related U.S. Application Data

[63] Continuation of application No. 08/600,351, Feb. 12, 1996, Pat. No. 5,739,768

[60] Provisional application No. 60/009,441, Dec. 29, 1995, and provisional application No. 60/002,614, Aug. 22, 1995.

[51] Int. Cl.[7] ..... G08G 1/01

[52] U.S. Cl. ..... 340/933; 340/901; 340/902; 340/436

[58] Field of Search ..... 340/933, 901, 340/902, 903, 943, 436; 246/473.1; 455/38.3

[56] References Cited

U.S. PATENT DOCUMENTS

| | | | |
|---|---|---|---|
| 1,978,286 | 10/1934 | Sommer | 250/2 |
| 3,735,342 | 5/1973 | Helliker et al. | 340/34 |
| 3,760,349 | 9/1973 | Keister et al. | 340/33 |
| 3,854,119 | 12/1974 | Friedman et al. | 340/902 |
| 3,949,300 | 4/1976 | Sadler | 340/901 |
| 4,296,496 | 10/1981 | Sadler | 455/1 |
| 4,864,306 | 9/1989 | Wiita | 340/991 |
| 4,931,793 | 6/1990 | Fuhrmann et al. | 340/903 |
| 4,942,395 | 7/1990 | Ferrari et al. | 340/907 |
| 5,036,478 | 7/1991 | MacDougall | 340/901 |
| 5,235,329 | 8/1993 | Jackson | 340/902 |
| 5,270,706 | 12/1993 | Smith | 340/902 |
| 5,278,553 | 1/1994 | Cornett et al. | 340/902 |
| 5,497,145 | 3/1996 | Yung et al. | 455/38.3 |
| 5,554,982 | 9/1996 | Shirkey et al. | 340/903 |
| 5,680,120 | 10/1997 | Tilleman | 340/436 |
| 5,699,986 | 12/1997 | Welk | 340/902 |
| 5,720,455 | 2/1998 | Kull et al. | 340/902 |
| 5,729,213 | 3/1998 | Ferrari et al. | 340/901 |
| 5,739,768 | 4/1998 | Lane et al. | 340/933 |
| 5,757,291 | 5/1998 | Kull | 340/933 |

OTHER PUBLICATIONS

"'Smart Highway' Business Attracts Aerospace Firms", *Aviation Week & Space Technology*, pp. 56–57, Jan. 31, 1994.

"Crisis at the Crossing?", *Railway Age*, pp. 35–40, Feb. 1994.

Association of American Railroads Communication Manual, Part 12–15, pp. 1–45, 1994.

*Radar Reporter* Jan. 1996 Monthly Newsletter, pp. 2–3.

*Primary Examiner*—Daniel J. Wu
*Assistant Examiner*—John Tweel, Jr.
*Attorney, Agent, or Firm*—Sidley & Austin

[57] ABSTRACT

Disclosed is a train proximity detector for detecting an RF carrier transmitted by a train, for a predefined period of time. Further, the encoded FSK data is decoded to determine if a match with a predefined data signature exists. If a match exists, visual and audio indications are provided to the operator, indicating a close proximity of a train. Modifications to train equipment can be made to cause the transmission of the carrier and FSK data on the activation of the train whistle, which is about 1500 feet from every crossing.

12 Claims, 2 Drawing Sheets

TRAIN PROXIMITY DETECTOR

RELATED APPLICATIONS

This is a continuation patent application of pending U.S. patent application Ser. No. 08/600,351 filed Feb. 12, 1996, now assigned U.S. Pat. No. 5,739,768, which claims the benefit of prior pending provisional patent application entitled "Locomotive Detection System; filed Aug. 22, 1995, and accorded Ser. No. 60/002,614, and attorney docket No. DZ-1138; and prior pending provisional patent application entitled "Train Proximity Detector", filed Dec. 29, 1995 and accorded Ser. No. 60/009,441, and attorney docket No. B-37824, the subject matter of each provisional and regular application of which is incorporated herein by reference.

TECHNICAL FIELD OF THE INVENTION

The present invention relates in general to detectors, and more particularly to FSK detectors for sensing signals transmitted by a train to determine the presence of the train.

BACKGROUND OF THE INVENTION

A constant concern exists as to the safety of vehicles where highways, streets and the like, intersect with railroad crossings. Despite the significant advances in technology utilized in both highway vehicles and trains, accidents involving collisions between trains and highway vehicles continue to occur, which accidents are generally catastrophic in nature.

Attempts to warn passenger vehicles and the like of oncoming trains involve many techniques that are old and well-known. For example, in U.S. Pat. No. 1,978,286 by Sommer, the system includes audio receiver equipment located on the train to detect the sound of whistles, warning bells and sounds to catch the general rumble of the train. Such sounds are coupled to the train-mounted receiver, which transmits the sounds by way of a radio transmitter. A receiver mounted in the vehicle then receives the transmission and alerts the vehicle occupants of the approaching train.

In U.S. Pat. No. 3,735,342 by Helliker et al, an alerting system is disclosed for alerting the occupant of a motor vehicle of the presence of an emergency vehicle siren. The frequencies generated by a typical siren are in the range of about 400–1500 Hertz. Three frequency-selective circuits in the receiver are responsive to sequentially detect the 600 Hz, 900 Hz and then 1200 Hz tones of the siren. On the detection of the specific sequence of frequencies, the motorist is alerted of the approaching emergency vehicle.

In U.S. Pat. No. 3,760,349 by Keister et al., an emergency warning system is disclosed in which a transmitter is mounted on an emergency vehicle for transmitting 500 Hz and 1000 Hz signals alternately modulated on an RF carrier. The transmitter is triggered when the siren is operated. A receiver in the motor vehicle receives the modulated signals, demodulates them and produces corresponding alternating audio signals to the vehicle operator, indicating the existence of a nearby emergency vehicle.

U.S. Pat. No. 4,942,395 by Ferrari et al., discloses a railroad grade crossing and motor vehicle warning system. In such system, a locomotive-mounted mounted transceiver transmits a coded radio signal to a transceiver mounted at the railroad crossing. The railroad crossing transceiver, in turn, transmits a shortwave radio signal to a vehicle-mounted receiver. The signal transmitted by the locomotive is apparently transmitted as long as the train is in motion.

U.S. Pat. No. 5,270,706 by Smith discloses a passive aircraft proximity detector for use with highway vehicles. According to this detector, a superheterodyne receiver mounted in the vehicle detects frequencies emitted from the aircraft, in the region of 900–1300 megahertz. On the detection of such frequencies, the receiver provides an indication to the vehicle when the aircraft is in range.

U.S. Pat. No. 5,235,329 by Jackson discloses an emergency vehicle detection device. Here, a signal in the citizens band frequency is transmitted by the emergency vehicle, in response to the actuation of a siren, and received by a receiver mounted in a near-by vehicle. The vehicle employs a band-selective receiver for detecting the particular frequency of transmission, or band of frequencies.

U.S. Pat. No. 5,278,553 by Cornett, et al. discloses a system of warning an approaching emergency vehicle. The system detects two frequencies that fall within the range of siren frequencies. When detection of such frequencies is sensed, audible and visible alarms are provided, and the vehicle sound system is de-energized.

Despite the disclosure of these warning systems, there is nevertheless a reluctance to adopt any one or more of the techniques on a widespread scale. By and large, the reason for this is that often both the emergency vehicle or train, as well as the highway vehicle to be warned, require modification or additional equipment, thereby involving an inconvenience during installation, as well as added expense. Indeed, and insofar as locomotives or rail traffic is concerned, any safety equipment for use thereon is governed by federal and other regulatory authorities. This necessarily incurs substantial expense in testing and approving the development of new equipment or any modification or addition to existing equipment. Further, in the event an alerting system is accepted on a widespread basis, such a system must be low-cost, reliable and easily implemented.

From the foregoing, it can be seen that a need exists for the provision of a detector for detecting the proximity of a train, without requiring any modification to the train at all, or at least only small modifications for enhanced performance. A further need exists for utilizing present train-transmitting facilities which are of high quality, which are reliable and time-tested type of equipment, where the transmissions thereof are received by remotely-located receivers. In this manner, on the routine transmission by a train, such as from the head end to the rear end thereof, or vice versa, such frequency can be detected by the remotely located receiver. A further need exists for a receiver utilizing conventionally available circuits, but provides a high degree of reliability and selectivity as to the transmissions by trains. Yet another need exists for utilizing frequencies allocated only to rail-type vehicles, thereby reducing the likelihood that other spurious frequencies will be received.

SUMMARY OF THE INVENTION

In accordance with the principles and concepts of the invention, there is disclosed a train proximity detector which substantially reduces or overcomes the shortcomings of the prior art devices. In accordance with an important feature of the invention, a detector includes an amplifier tuned to the specific carrier frequency authorized for use only by trains. When a train normally provides an FSK transmission from the head end thereof to a receiver mounted on the last car, a remotely located receiver, such as in a vehicle, intercepts the transmission. Further, the detector according to the preferred embodiment of the invention, verifies that the transmitted carrier frequency is present for a predefined period of time. On the detection of the carrier frequency for the predefined period of time, a yellow LED is illuminated. The FSK data transmitted by the head end transmitter is decoded and compared with a prestored pattern of data that is characteristic of every train transmission. On the detection of the predefined pattern of data encoded on the carrier, a red LED is illuminated. With the precise detection of the parameters characteristically transmitted by trains, the remotely-located receiver provides both visual and audio alarms indicating the presence of a train.

In accordance with another feature of the invention, the train equipment can be modified in a minor manner so that when the whistle is blown at about 1500 feet before an intersection, a redundant transmission by the head end transmitter is caused to be made, thereby assuring that any nearby motorist with the receiver is warned of the presence of the train in the immediate vicinity.

BRIEF DESCRIPTION OF THE DRAWINGS

Further features and advantages will become apparent from the following and more particular description of the preferred embodiment of the invention, as illustrated in the accompanying drawings in which like reference characters generally refer to the same parts, elements or functions throughout the views, and in which.

DETAILED DESCRIPTION OF THE INVENTION

The train proximity detector described below receives a carrier and frequency shift key (FSK) data typically transmitted by the "head of train" or head end device which is typical of free space transmissions of data from the locomotive to a receiver mounted to the last car of the train. The frequency band allocated specifically to such transmissions is 450–460 MHz, with the frequency of 452.9375 megahertz being one frequency presently of interest in the employment of the invention. The carrier frequency of 452.9375 Mz is allocated for transmission of FSK data from the head of train to the rear of train. Conversely, the carrier frequency of 457.9375 MHz is allocated for the transmission of an acknowledgment and other data from the rear of train to the head of train. The encoded FSK data transmitted between the locomotive and the rear-most car monitors the status of various parameters, such as brake pressure, speed, etc., while the train moves along the track. The carrier frequency is modulated by 1200 hertz and 1800 hertz signals to encode digital data on the carrier. The encoding of data is in accordance with the protocol specified by the AAR, dated 1994, and identified as "Recommended Guidelines, Considerations and Radio Frequency Requirements for Train Information Systems", Part 12–15, pages 1–45, the subject matter of which is incorporated herein by reference.

A typical frame of data, including synchronizing bits, data bits, parity bits, etc., typically include 672 bits of FSK data transmitted within a 560 millisecond period of time. According to the invention, the rain proximity detector receives the FSK data frame, checks the baud rate, verifies that the carrier is present for a predefined period of time, and verifies a specific bit pattern or "signature" of the data to thereby verify that the transmission was from the head end transmitter of a train. Further, the train is contemplated to be modified in a manner so that when the whistle button is activated at a predefined distance from a crossing, the whistle not only blows, but the head end transmitter is caused to transmit a frame of data. In this manner, when the train whistle is blown at about 1500 feet from a crossing, any nearby vehicle equipped with the train proximity detector of the invention will be alerted by both audio and visual indicators. The prevention of accidents between trains and vehicles at crossing intersections is thereby facilitated.

Figure 1:
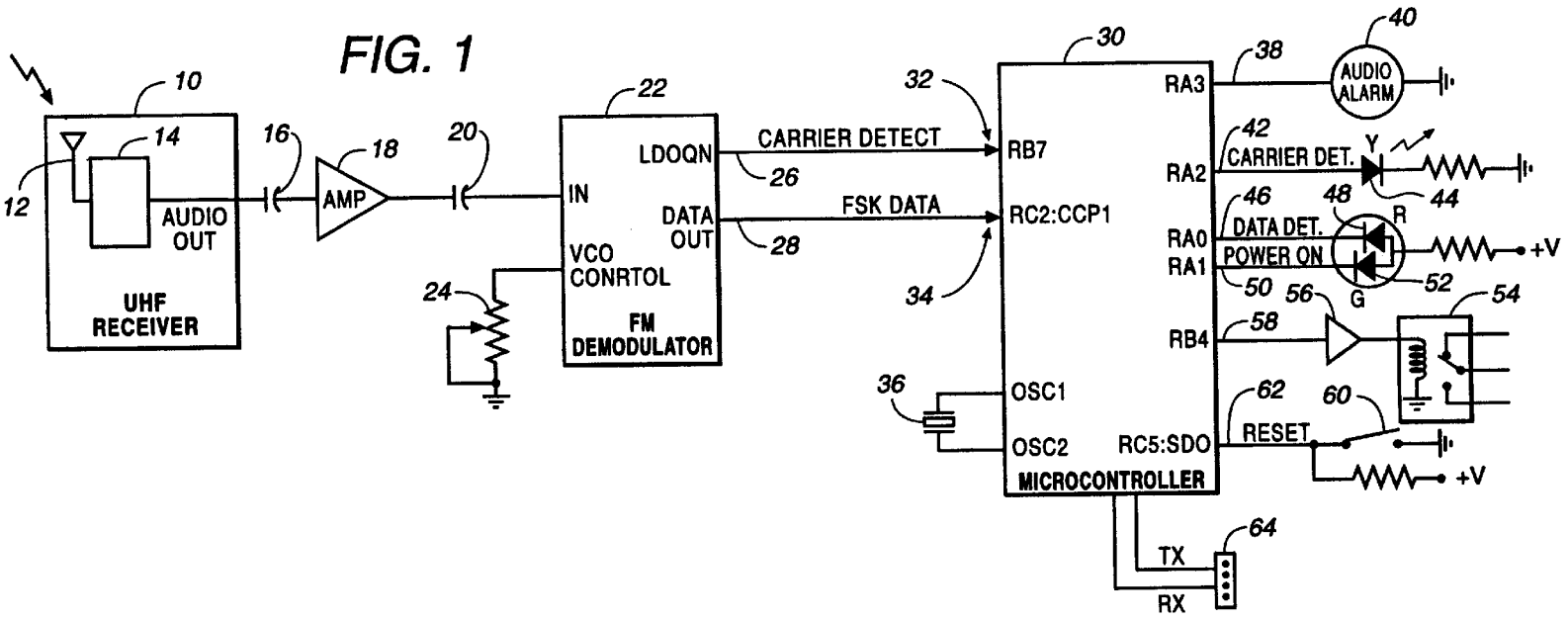
FIG. 1 is a detailed block diagram of the train proximity detector according to the preferred embodiment of the invention.

With reference to FIG. 1, there is illustrated a block diagram of the train proximity detector according to the preferred form of the invention. The detector includes a UHF receiver 10 of the type adapted for receiving FSK modulated carrier frequencies transmitted by trains, namely 452.9375 megahertz. The UHF receiver 10 is of the type A04CJC/A04CJB utilized in pagers of the same type. Such pagers are obtainable from the Motorola Corporation. This type of pager employs a receiver board and a decoder board. The modification thereto according to the invention involves the use of only the receiver board having the UHF receiver and the crystal replaced so as to operate with an incoming carrier frequency of 452.9375 MHz, i.e., the head of train transmitting frequency. The receiver board 14 includes an internal antenna 12 and other circuits, as well as RF amplifiers, oscillators, mixers, a demodulator, multipliers, first and second IF amplifiers, an audio frequency output, etc. According to a feature of the invention, the antenna and/or the front end receiver of the UHF receiver 10 is detuned to make the train proximity detector responsive to signal strength transmissions only within the general location of the detector, such as within about ½–¼ mile. This is advantageous, as it is undesirable to detect transmissions from the head end transmitter of trains more than about three miles from the detector. Moreover, the bandpass characteristics of the UHF receiver 10 provide a first IF center frequency of 45 MHz, with a bandpass of only 6–7 KHz about the center frequency. This sharp bandpass characteristic allows a very narrow band around the train transmission carrier frequency to be received, with the out-of-band frequencies being rejected. Thus, if the carrier frequency received by the UHF receiver 10 is not substantially 452.9375 MHz, it is rejected, even if the other transmitted parameters are correct.

The audio output of the UHF receiver 10 is coupled via a blocking capacitor 16 to a single-transistor amplifier 18 for amplifying the AC signals. Essentially, the output of the UHF receiver is the demodulated analog audio signals comprising the FSK data. The output of the amplifier 18 is coupled via a capacitor 20 to an FM demodulator 22 for converting the FSK signals to corresponding digital signals. In the preferred form, the FM demodulator 22 is an integrated circuit type XR-2211, obtainable from EXAR Corporation, San Jose, Calif. A potentiometer 24 is connected to the VCO input of the FM demodulator 22 to fine tune the free-running frequency of the voltage controlled oscillator with the frequency of the FSK signals. Other components, such as capacitors and resistors, are utilized to adjust the free-running frequency, the value of such components being selected according to the data sheets provided with the XR-2211 demodulator chip. Thus, the potentiometer 24 is therefore only illustrative of the components connected to various pins for fine tuning the VCO frequency.

The FM demodulator 22 includes a lock detect complement output 26. Essentially, the lock detect complement output 26 is at a logic high state when the internal phase lock loop is out of lock with the FSK signals, and goes to a low state when the phase lock loop is locked. The output 26 thus detects the presence of the FSK frequency signals and is denoted "carrier detect." The FM demodulator 22 also includes a data output 28 for providing logic signals corresponding to the FSK signals. The digital signals provided on the carrier detect output 26 and the FSK data output 28 are coupled to a microcontroller 30. According to the AAR protocol, the carrier is modulated with a 1200 hertz tone and an 1800 hertz tone. The FM demodulator 22 is configured so that the digital zero is generated in response to the detection of the 1200 hertz tone, and a binary digit 1 is generated on the detection of the 1800 hertz tone.

The FM demodulator of the type identified above is designed to verify the baud rate of data transmission, as well as the particular pair of FSK frequencies. The baud rate of data transmitted by the train is 1200, with the FSK frequencies being 1200 and 1800 Hertz, as noted above. If the transmitted baud rate is 1200, and if the FSK frequencies received are within a small tolerance of 1200 and 1800 Hertz, then the FM demodulator 22 provides corresponding decoded data on the output. If either of these parameters do not correspond to the protocol, the data is rejected even if the other parameter, i.e., the carrier frequency, is found to be within limits. This feature of the invention provides a high degree of selectivity in assuring that a transmission is indeed from a train, and not from some other source with similar parameters. It can be appreciated that false detections are thus substantially reduced and vehicle operator confidence in the proximity detector is enhanced.

In the preferred form of the invention, the microcontroller 30 is of the type PIC16C73, obtainable from Microchip Technology, Chandler, Ariz. The microcontroller 30 has an interrupt input 32 for interrupting the processor when a carrier detect signal is present, i.e., on the presence of either of the 1200 or 1800 Hertz tones. Also included is a capture input 34 for capturing the data bits output by the FM demodulator 22. A 4.0 MHz crystal 36 provides an oscillator signal to the appropriate inputs of the microcontroller 30. An output port 38 provides a reference voltage for activating an audio alarm 40, preferably of the piezoelectric type. An output port 42 can be programmed to provide an output signal for illuminating a yellow light emitting diode (LED) 44 for indicating the presence of the transmitted train signal for a predefined period of time. The illumination of the yellow LED constitutes a first level alert. Output port 46 is programmable to be driven to a logic low to illuminate a red LED 48 when data is detected. The illumination of the red LED constitutes a second level alert. Output port 50 is programmable so that it can be driven to a logic low to illuminate a green LED 52 when DC power is applied to the train proximity detector. It is contemplated that the typical automotive voltage (12 volts) will be utilized, together with series regulators to reduce the voltage, if necessary, to power the various circuits of the detector.

An auxiliary relay 54 can be driven via a buffer driver 56 by way of output port 58. The microcontroller 30 can be programmed so that on the occurrence of various events, the relay 54 will be operated to simultaneously close a set of contacts and open a set of contacts. With the relay 54, other warning systems can be activated. The warning system could be actuated without the sounding of the audible whistle and enable a "silent alarm" to equipped vehicles providing an adequate warning without causing the problems encountered in the "whistle ban" areas that have been created to avoid bothering the non-motoring residents. The relay 54 can also be utilized for test purposes or can be utilized by other equipment to count the number of events that have occurred, as determined by the programmed operations of the microcontroller 30. The train proximity detector includes a reset switch 60 that is manually operable by the operator to reset the microcontroller 30, such as after various alarms have been triggered, again according to the programmed routine. The reset switch 60 is connected to an interrupt input port 62 of the microcontroller 30. A transmit receive (Tx/Rx) port 64 is connected to a respective SCI asynchronous receive and SCI asynchronous transmit port of the microcontroller 30 for programming the memory, or for reading data therefrom.

Figure 2:
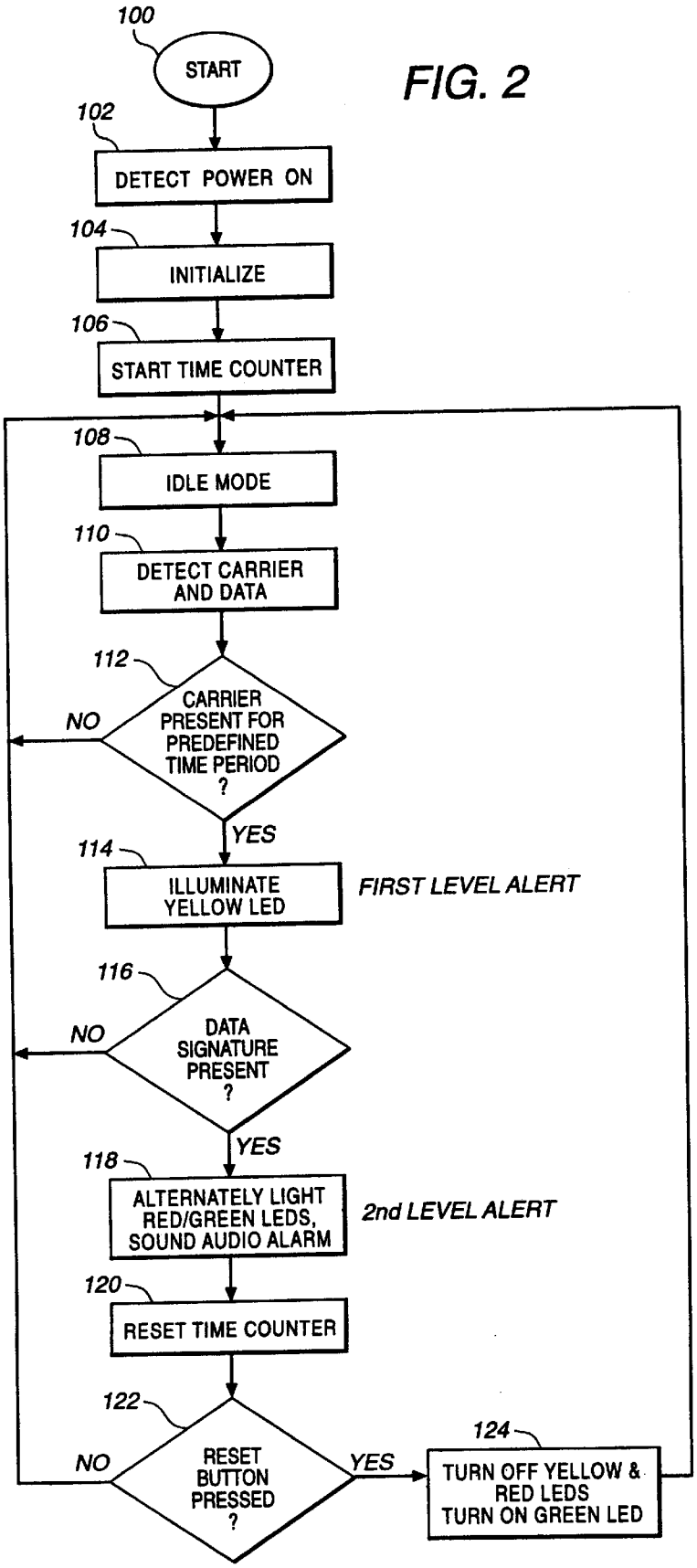
FIG. 2 is a flow chart showing the programmed operations of the microcontroller that controls the detector.

Having set forth the electrical circuits of the train proximity detector, reference is now made to FIG. 2 where there is illustrated the programmed operations of the microcontroller 30. The microcontroller includes an on-board electrical programmable read only memory (EPROM) for storing an operating program.

In the program flow chart of FIG. 2, the microcontroller 30 starts at block 100 and proceeds to block 102 when battery power is applied to the detector. Power is applied to the train proximity detector by way of a toggle switch (not shown) on the face plate, which also supports the audio alarm 40, the yellow carrier detect LED 44, the red data detect LED 48, the green power on LED and the reset button 60. Once power to the unit is detected, the microcontroller 30 proceeds to block 104, where initialization procedures are carried out. During initialization, a software up-counter is reset, the green LED 52 is illuminated via output port 50, the microcontroller on-board memory is checked, as are various registers, according to a programmed diagnostics routine. If the diagnostics fail, a single audio tone is emitted from the audio alarm 40, and all LEDs are extinguished. Once a successful initialization has been established, the microcontroller 30 proceeds to block 106, where the up-counter is started. The counter is incremented in software once every minute, and thus constitutes a time counter. Sufficient digits are provided to count up to 45 days, or more. As will be described more fully below, the time counter measures an elapsed period of time after the occurrence of a level two alert. The contents of the time counter can be externally read, via the Tx/Rx port 64.

After the time counter is started, the microcontroller 30 proceeds to the idle mode, as shown in program flow block 108. In the idle mode, the microcontroller 30 waits for the detection of an RF carrier and a FSK data stream, as provided by the FM demodulator 22. In program flow block 110, when the RF carrier logic signal is detected on input port 32 and data is detected on the input port 34, the microcontroller 30 proceeds to decision block 112. Here, it is determined whether or not the carrier signal on input port 32 is present for a predefined period of time. In the preferred embodiment of the invention, the predefined period of time is about 25 milliseconds. However, such time is arbitrary and thus other time periods may be more suitable for particular purposes. If the carrier is not present for the predefined period of time, the microcontroller 30 branches back to the idle mode 108. If, on the other hand, the carrier signal is detected for at least the predefined period of time, processing proceeds to block 114. The yellow LED 44 on the face plate of the detector indicates to the vehicle operator that an RF carrier transmitted by a train has been detected. Also, the audio alarm is sounded once. The detection of the carrier signal transmitted by a trin constitutes yet another parameter that must be met in order to assure that a detection was indeed that transmitted by a train.

From program flow block 114, the microcontroller 30 proceeds to decision block 116 where it determines if the received data pattern constitutes a specified data signature. In this group of instructions, the microcontroller 30 compares the pattern of data bits received on input port 34 with a predefined pattern, as stored in the EPROM memory. The predefined data pattern can be any group of bits routinely transmitted by a train, such as that shown by the AAR protocol of FIG. 3. The 672-bit frame 130 transmitted on the carrier of 452.9375 MHz is characteristic of the format transmitted by train head end transmitters. As noted above, the 672 bits of the frame are transmitted in a 560 millisecond time period.

Figure 3:
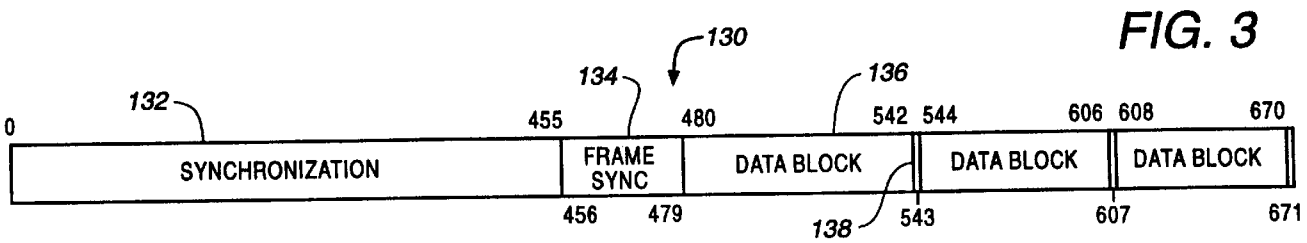
FIG. 3 illustrates a multi-field frame of bits transmitted by a train according to the American Association of Railroads protocol.

The frame 130 of FIG. 3 includes a number of fields, the first field 132 being a 456-bit synchronization field. In the preferred form of the invention, the authorized synchronization signal transmitted by trains includes 456 bits of alternating zeros and ones. In decision block 116, the microcontroller 30 determines if at least the first eight bits of the synchronization field constitutes alternating ones and zeros or alternating zeros and ones. Those skilled in the art may find that it is more advantageous to compare the bits of other fields of the frame, or various bits from several fields. Indeed, it would be advantageous if the frame of bits included a field showing the activation of the train whistle at the specified 1500 feet from every crossing. In this manner, the train proximity detector could not only detect the presence of the frame, but also detect that the train is about 1500 feet from the crossing. Other data or bit patterns within the frame can also be detected, as the need arises.

The AAR head end transmission frame 130 includes a 24-bit field 134 for frame synchronization purposes, and then three groups of a pair of fields constituting a 63-bit field 136 for a data block and a 1-bit field 138 for odd parity. The three data blocks have identical data and represent a rear unit address code, a command block and a batch code block. While the format of FIG. 3 represents a front end transmission format, the detector can also be configured to also detect the format of a rear-to-front transmission which is on a different carrier frequency. Further, when the head end transmitter transmits to the rear car of the train, the rear transceiver acknowledges the transmission with a "handshake" rear-to-front transmission. Those skiled in the art may prefer to also detect one or more of these transmissions to improve the reliability of the detection scheme.

If the data signature stored in the EPROM memory matches that received on the data input port 34, the microcontroller 30 proceeds to block 118 where the green LED 52 is alternately illuminated with the red LED 48. This is a warning of a second level alert. Further, the audio alarm 40 is activated to provide an audio indication to the vehicle operator that a bona fide train signal has been received. The LEDs 48 and 52 are alternately illuminated at a perceptive rate of about 200 ms, and the audio alarm is activated. As noted above, the UHF receiver 10 can be adjusted to detune the sensitivity of the detector. In other words, the gain or sensitivity of the UHF receiver 10, or other circuits, can be adjusted so that the train proximity detector is less sensitive to the reception and detection of train RF transmissions. In this manner, trains further than about ½–1 mile from the detector will not be detected, even if such trains transmit on the allocated frequency. This prevents the train proximity detector from providing detections of trains that are of no real danger to the vehicle operator, in that too great a distance exists between the train and the detector. Yet other techniques are available for desensitizing the detector to limit the range of operation thereof. From the foregoing, with the yellow LED 44 indicating the detection of a carrier, and with the red LED 48 and green LED 52 alternately blinding to indicate the detection of the data signature, the operator is fully aware that extreme caution should be exercised, i.e., a second level alert. Not only is the red LED 48 and the green LED 59 alternately illuminated, but the audio alarm 40 also provides an audio indication of the second level alert.

From program flow block 118, the microcontroller 30 proceeds to block 120, where the time counter is reset. In other words, once a second level alert is reached, the time counter started in block 106 is reset to start the time anew. The counter remains counting in one minute increments until the detector is either initialized (block 104) or a subsequent second level alert is detected. In the event an accident occurs between the train and the vehicle equipped with the detector, the contents of the time counter, which are stored in a register, are read via port 64 to determine the approximate time elapsed since the detector sensed a second level alert. An accident sensing device may comprise an air bag type actuation switch, which signals the microcontroller 30. While not shown above, it is contemplated that the train proximity detector will be equipped with a back-up supply voltage, in the nature of a lithium battery. Thus, even if the battery voltage of the vehicle is removed from the detector, the detector will maintain minimum operations. To that end, provisions can be made for placing the microcontroller 30 in a sleep mode on the occurrence of the removal of the vehicle battery supply voltage. In the sleep mode, the microcontroller 30 can turn off the audio alarm 40 and any LEDs that are illuminated to conserve power. Further, in the sleep mode, the microcontroller 30 can be programmed to maintain the one-minute increments to the counter, and the storage of the same in an internal register.

From block 120, the microcontroller 30 proceeds to decision block 122 to determine if the reset button 60 has been pushed. If the reset button 60 has not been pushed, the program flow branches back to the idle mode 108. If, on the other hand, the reset button 60 has been depressed by the vehicle operator, program flow block 124 is encountered. Here, the yellow and red LEDs are extinguished and the green LED 52 is illuminated to indicate that power remains applied to the detector. From program flow block 124, the processor branches back to the idle mode 108.

While the foregoing illustrates the basic software operations in controlling the microcontroller 30, many other instructions, subroutines and decisions can be implemented to streamline the operation or to supplement the detector with additional features. Indeed, it may be found that not all of the parameters detected are necessary to assure that a sensed transmission was from a train. In addition, the detector can be designed to demodulate or decode and/or identify digital encoding, analog encoding, phase modulation, etc.

Figure 5:
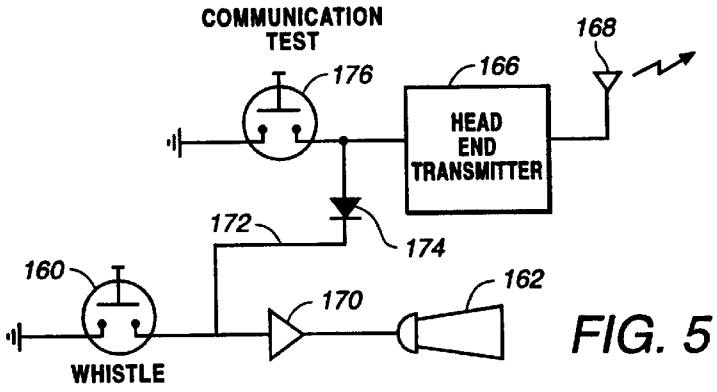
FIG. 5 illustrates a modification of control circuits of certain train systems, wherein both the whistle and transmitter are activated when the whistle button is pushed.
Figure 4:
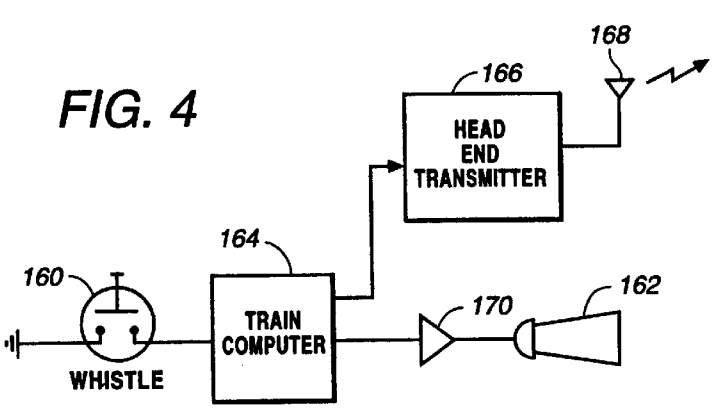
FIG. 4 is a block diagram of the computerized operation of a train for activating a transmitter when the whistle button is pushed.

Reference is now made to FIGS. 4 and 5, where there is illustrated modifications to the train equipment to further facilitate the detection of a train in close proximity to the detector, i.e., near a crossing. While the detector of FIG. 1 is effective to detect train head end transmissions in the area of reception, irrespective of the proximity to crossings, the inventions of FIGS. 4 and 5 cause head end train transmissions to occur when the train whistle is blown, which is required at about 1500 feet from crossings.

In FIG. 4, there is diagrammatically illustrated the train whistle button 160 for activating the train whistle 162. In actual practice, the button 160 can be a pull string, a manually operated button, a switch, etc. Further, the train whistle 162 can be an audio signal that is mechanically, electrically or electronically generated. Modern trains are equipped with a computer 164 that controls or monitors many of the operator switches. Indeed, a computer interface (not shown) can be provided so that the computer 164 can scan the operator input devices. When the computer 164 detects that the whistle button 160 has been activated, a signal is forwarded to the head end transmitter 166 to cause a transmission on the allocated frequency. The transmitter 166 transmits frames of data, such as shown in FIG. 3, by way of an antenna 168. On activation of the whistle button 160, the computer 164 also signals a driver 170 for driving the train whistle 162. It is contemplated that the configuration of FIG. 4 can be implemented by minor modification of the software of the train computer 164 to not only activate the whistle 162 when the button 160 is depressed, but also to cause a transmission via the head end transmitter 166. Although there is no necessity, as to the train itself, of causing a transmission when the whistle button 160 is pushed, such transmission may be redundant but nevertheless provides a medium for communicating to the train proximity detector an indication of the proximity of a train, even if the whistle cannot be heard by the vehicle operator.

In FIG. 5, there is shown other train apparatus reconfigured to cause an RF transmission when the train whistle button 160 is depressed. Here, the whistle button 160 is coupled via a driver 170 to the train whistle 162. In addition, the output of the train whistle 160 is coupled by way of conductor 172 to the head end transmitter 166, via a diode 174. Also shown connected to the same input of the head end transmitter 166 is a conventional communication test button 176. To test the train communications equipment, the engineer depresses the communication test button 176 which enables the head end transmitter 166 to transmit a test frame of data. The diode 174 prevents the whistle 162 from being activated in response to the depression of the communication test button 176. However, when the whistle button 160 is depressed, the head end transmitter 166 is also enabled, thereby providing a test communication whenever the whistle 162 is blown. While FIGS. 4 and 5 show basic modifications of locomotives to provide transmissions of data in response to the depression of the whistle button 160, many other techniques and variations of the foregoing are available to those skilled in the art.

While the preferred embodiment of the invention has been disclosed with reference to a specific train proximity detector, and methods of operation thereof, it is to be understood that many changes in detail may be made as a matter of engineering or software choices, without departing from the spirit and scope of the invention, as defined by the appended claims.

What is claimed is:

1. A method of detecting a proximity of a train equipped with a transmitter that transmits a modulated carrier frequency allocated specifically to trains, comprising the steps of:

intercepting and receiving the carrier frequency by a proximity detector remotely located from the train only when the train is transmitting said modulated carrier frequency to a train-mounted receiver;

using a narrow band circuit in said proximity detector to reject processing of all other frequencies outside said narrow band;

ascertaining the existence of a bona fide transmission by the train of the carrier frequency; and in response to the bona fide transmission of the carrier frequency by the train, producing a signal that causes a sensory warning of the proximity of the train.

2. The method of claim 1, wherein said carrier frequency is allocated specifically for use by trains by a governmental agency.

3. The method of claim 2, further including using a transmitter complying with regulations and specifications required by said governmental agency to transmit said modulated carrier frequency.

4. The method of claim 1, further including mounting said proximity detector in a vehicle that is not a train, and producing said sensory warning by said proximity detector.

5. A method of detecting a proximity of a train having a transmitter mounted thereto, where said transmitter transmits a carrier frequency allocated specifically to trains, comprising the steps of:

receiving said carrier frequency by a receiver not mounted to said train, but mounted remotely from said train;

amplifying said received carrier frequency using an RF amplifier and at least one IF section tuned for a narrow bandpass to thereby provide a high rejection of out-of-band frequencies;

detecting a presence of said carrier frequency after amplification by said IF amplifier, for a period of time ranging in the milliseconds; and if said carrier frequency is detected as being present for said period of time, then providing an indication of the proximity of the train using a sensor warning device, whereby the proximity of the train is detected with a high degree of accuracy.

6. The method of claim 5, further including passing signals through said IF amplifier with a bandpass of between about 6–7 KHz.

7. The method of claim 5, further including verifying the presence of said carrier frequency for at least twenty milliseconds.

8. The method of claim 5, further including demodulating data bits encoded on said carrier frequency, and verifying whether a pattern of said data bits is associated with the train.

9. The method of claim 8, further including providing a first sensory warning when the presence of said carrier frequency has been detected for said period of time, and providing a second different sensory warning when said pattern of data has been verified.

10. The method of claim 5, further including demodulating data bits encoded on the carrier frequency that represent a distance of the train from a crossing.

11. The method of claim 5, further including detecting a carrier frequency transmitted from a train head-end transmitter to a train rear-end receiver.

12. The method of claim 5, further including mounting a train proximity detector in a mobile vehicle.

* * * * *